United States Patent [19]

Young

[11] Patent Number: 4,844,526

[45] Date of Patent: Jul. 4, 1989

[54] GOLF BALL RETRIEVER

[76] Inventor: Fred E. Young, 804 S. 22nd Ave., Yakima, Wash. 98902

[21] Appl. No.: 100,215

[22] Filed: Sep. 23, 1987

[51] Int. Cl.[4] ..... A63B 47/02

[52] U.S. Cl. ..... 294/19.2

[58] Field of Search ..... 294/19.1, 19.2, 55; 273/32 F, 162 E

[56] References Cited

U.S. PATENT DOCUMENTS

| | | | |
|---|---|---|---|
| 1,431,968 | 10/1922 | McDermott | 294/19.2 |
| 1,674,294 | 6/1928 | ORourke | 294/19.2 |
| 2,058,709 | 10/1936 | Molinare | 294/19.2 |
| 2,270,632 | 1/1942 | Hasty | 294/19.2 |
| 2,738,214 | 3/1956 | Zimmers | 294/19.2 |
| 3,046,044 | 7/1962 | Christle | 294/19.2 |
| 3,306,649 | 2/1967 | Zagwyn | 294/19.2 |
| 3,442,544 | 5/1969 | Faber | 294/19.2 |
| 3,743,338 | 7/1973 | Seeger | 294/19.2 |

FOREIGN PATENT DOCUMENTS

| | | | |
|---|---|---|---|
| 2791 | of 1902 | United Kingdom | 294/19.2 |

*Primary Examiner*—Johnny D. Cherry

*Attorney, Agent, or Firm*—Graybeal, Jensen & Puntigam

[57] ABSTRACT

A golf ball retriever comprising a partially ellipsoidal basket having a pocket for retaining the golf ball at the basket's far end, and a telescoping pole carrying the basket perpendicularly on the pole's far end. The basket is a partial section of an ellipsoidal surface greater than a semi-ellopsoid, and opens along its major or long axis toward the handle end of the pole. The basket comprises a flat central member and five radially spaced, upwardly curving webs separated by gaps smaller than the diameter of the ball. The pocket is formed by the gap between the two webs farthest from the pole.

3 Claims, 1 Drawing Sheet

GOLF BALL RETRIEVER

DESCRIPTION

1. Technical Field

This invention relates to golf equipment, and more particularly to devices for retrieving golf balls from water hazards and other inaccessible areas.

2. Background Art

Golf provides numerous and varied hazards into which golf balls are commonly hit, and from which they must be retrieved. Small ponds or water hazards placed in or near the fairway regularly receive errant balls.

The prior art includes several devices for retrieving golf balls. These devices typically comprise an extensible telescoping pole, and means attached to the distal end of the pole for receiving and retaining the golf ball. The retaining means of these prior art devices can be classified into those with and those without moving parts. Through experience, it has been found that retaining means having moving parts are notoriously unreliable, because the moving parts can become jammed or otherwise fail to operate properly.

Unfortunately, it has also been found through experience that the prior art retrievers having retaining means without moving parts are frequently incapable of successfully retaining and retrieving golf balls in real-life conditions. For example, the retaining means in U.S. Pat. No. 3,306,649 to Zagwyn comprises a hemispherical retaining means with which the golfer must "fish" until the ball is netted in the open mesh. No provision is made for retaining the ball in the retriever, other than the golfer's maintaining the retriever upright.

U.S. Pat. No. 2,270,632 to Hasty discloses a golf ball retriever having as its retaining means an elongated basket. As described, the operation of this retriever requires that the elongated basket be drawn toward the ball so that the ball enters one end of the basket. The pole must then be carefully manipulated to twist the basket or move it laterally so that the ball will roll into a partially spherical pocket at the central portion of the basket. The difficulty of accurately twisting or moving laterally such an elongated basket at the far end of a long telescoping pole without dislodging the ball will be readily appreciated.

DISCLOSURE OF THE INVENTION

The invention of this application resides in a golf ball retriever comprising a pole and a basket attached to the pole. The basket has an opening for receiving the ball into the basket. A pocket formed at an end of the basket retains the golf ball within the basket while the pole and basket are lifted to retrieve the ball.

Other features and advantages of this invention will become apparent from the following detailed description of a typical embodiment thereof, taken in conjunction with the accompanying drawings.

BEST MODE FOR CARRYING OUT THE INVENTION

Figure 1:
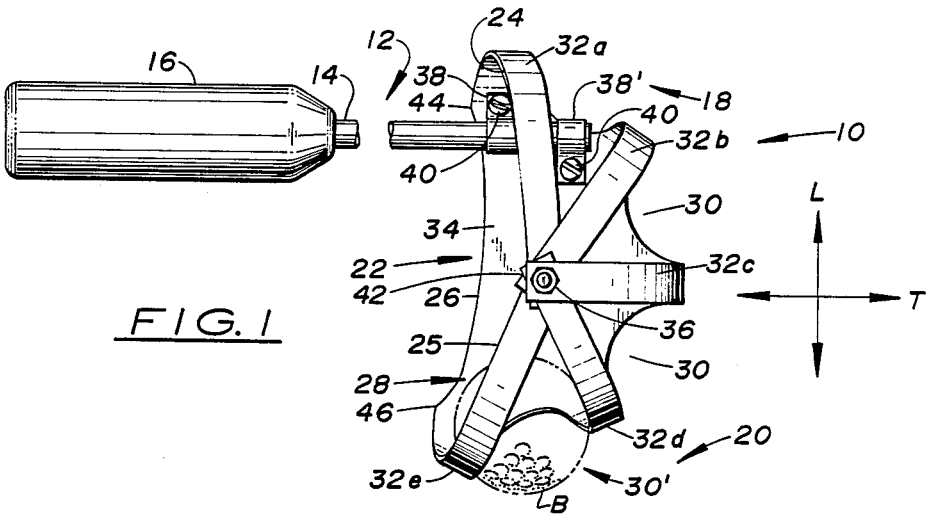
FIG. 1 is a front view of the ellipsoidal basket of a golf ball retriever according to this invention.

As will be seen from FIG. 1, the golf ball retriever of this invention comprises a partially ellipsoidal basket 10 affixed to a telescoping pole 12 having multiple telescoping sections 14 and a handle 16.

The basket 10 is substantially in the form of a partial section of an ellipsoid greater than a semi-ellipsoid. An ellipsoid is defined in Webster's Third New International Dictionary, Unabridged, 1961 Edition, as "a surface all plane sections of which are ellipses or circles." The basket 10 has an opening 22 substantially along the ellipsoid's major or long axis L. The basket 10 is greater than a semi-ellipsoid, in that the basket comprises more than an exact half-section of an ellipsoid.

The long, transverse and vertical reference axes L, T, V of the basket 10 comprise the three orthogonal axes of symmetry of the ellipsoidal surface of which the basket is a partial section. The major or long axis L of the basket 10 extends between opposite ends 18, 20 of the basket. A transverse axis T of the basket 10 is perpendicular to the basket's axis L. Finally, a vertical axis V of the basket 10 is mutually perpendicular to the basket's long axis L and transverse axis T.

Figure 3:
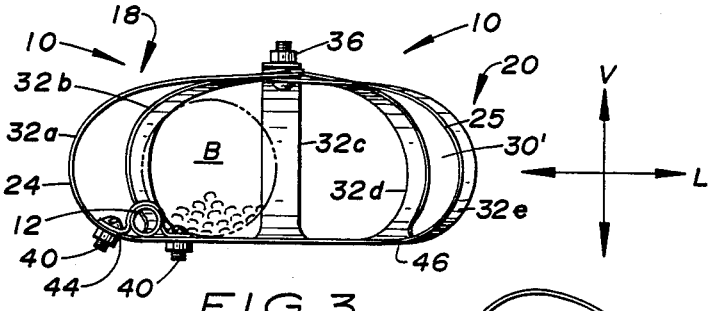
FIG. 3 is a side view of the basket of FIG. 1, looking into the basket's opening.

The shape of the basket 10 is best conveyed by describing the ellipsoidal surface of which the basket is a partial section, with reference to FIGS. 1 and 3 of the drawings. Because the basket 10 opens substantially along its long axis L, the depth of the basket 10 measured along its transverse axis T will be about one-half the dimension across the ellipsoidal surface measured along the same transverse axis. The basket's dimensions along its long axis L and vertical axis V will be substantially the same as the dimensions of the ellipsoidal surface along those axes.

The basket 10 and the ellipsoidal surface of which the basket is a partial section both measure about 5.25 inches along the long axis L and about 2.0 inches along the vertical axis V. The depth of the basket 10, measured along the transverse axis T from the basket's opening 22 to the opposite surface of the basket, is about 2.0 inches.

The basket 10 includes an opening 22 through which the golf ball B is scooped into the basket. The opening 22 opens toward the handle 16 of the pole 12, so that as the basket 10 is pulled by the golfer toward the golf ball B, the ball will be scooped through the opening 22 into the basket 10.

The basket's opening 22 is substantially defined by three edge portions 24, 25, 26 which together form the perimeter of the opening 22. These edge portions are: a near edge 24 closer to the pole 12, a far edge 25 farther from the pole, and an intermediate edge 26 connecting edge portions 2,, 25. The near and far edges 24, 25 meet at a midpoint 42 of the opening 22. The opening's midpoint 42 is located substantially along the basket's vertical axis V. The near and far edges 24, 25 of the opening 22 respectively meet the opening's intermediate edge 26 at near and far corners 44, 46 of the opening.

The near edge 24 extends from the midpoint 42 of the opening 22 radially toward the pole 12, following the ellipsoidal surface of the basket 10 around the near end 18 of the basket and around the pole 12 to meet the intermediate edge 26 of the opening 22 at the near corner 44 of the opening 22. If the article is oriented such that the pole is seen as being generally perpendicular to the basket, then the near edge 24 is angled slightly from the basket's long axis L toward the handle 16 of the pole 12, i.e. the near edge forms an angle of about 10 degrees relative to the basket's long axis L at the midpoint 42 of the opening 22.

The far edge 25 of the opening 22 extends from the midpoint 42 radially outwardly away from the pole 12, following the ellipsoidal surface of the basket around the far end 20 of the basket 10 to join the opening's intermediate edge 26 at the far corner 46 of the opening. Again if the article is viewed such that the pole is perpendicular to the basket, the far edge 25 is angled from the basket's long axis L toward the pole's handle 16, about 25 degrees relative to the basket's long axis L from the opening's midpoint 42. Because the near and far edges 24, 25 of the opening 22 meet at the opening's midpoint 42, which is on the basket's vertical axis V, the near and far edges 24, 25 thus define an opening 22 subtending an angle of about 145 degrees about the basket's vertical axis V.

The angles of 10 degrees and 25 degrees mentioned above for the near and far edges are based, as indicated, on the pole being perpendicular to the long axis L. In another view of the article, if the peripheral edge of opening 22 is oriented so as to be symmetrical relative to axis L, then the pole is seen to be attached to the basket at an angle in the range of 10 degrees-25 degrees relative to long axis L, with the angles of near and far edges 24, 25 being each 17-½degrees relative to long axis L.

As seen most clearly in FIG. 1, the intermediate edge 26 of the opening 22 extends from the opening's near corner 44 adjacent the pole 12 to the opening's far corner 46. The intermediate edge 26 extends along the substantially flat lower surface (as oriented in FIG. 3) of the basket 10, and curves slightly at each end to produce a concave edge which facilitates scooping the ball B through the opening 22 into the basket 10.

The angles of the far and near edges 24, 25 of the basket's opening 22 toward the pole's handle 16, as explained above, thus provide a partially ellipsoidal basket 10 which is greater than a semi-ellipsoid, and which opens along its long or major axis L toward the handle.

Figure 2:
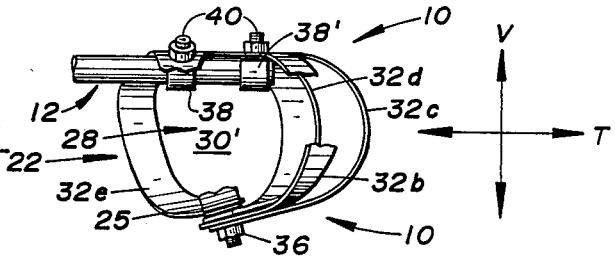
FIG. 2 is a partially broken away end view of the basket of FIG. 1.

The process of scooping the ball B into the basket 10 is additionally facilitated by the midpoint 42 of the opening being offset or displaced from the location of intermediate edge 26 along axis T, as most clearly shown in FIGS. 1 and 2.

As seen in FIG. 1, the basket 10 is not a solid surface, but rather is substantially perforated by gaps 30 between webs forming the basket. The webs comprise five flat curved strips 32*a*, 32*b*, 32*c*, 32*d*, 32*e* conforming to the ellipsoidal surface of which the basket 10 is substantially a section. The webs 32*a–e* are arranged at substantially regular intervals around the ellipsoidal surface of the basket 10, radiating generally from the basket's vertical axis V. The five webs 32*a–e*, each about 0.5 inch wide, result in gaps 30 which are about 1.4 inches wide at their widest points. Because the diameter of a standard golf ball B is about 1.65 inches, these gaps 30 do not allow the ball to fall through them. The gaps 30 facilitate drawing the basket 10 through water, by allowing the water to flow through the basket, while insuring that the ball B will be retained in the basket between adjacent webs.

The basket 10 retains the golf ball B in a pocket 28 created by the gap 30' between the two webs 32*d*, 32*e* at the basket's far end 20. The 1.4 inch gap 30' of the pocket 28 allows about twenty-five percent (25%) of the diameter of the golf ball B to protrude through the gap. When the ball B is placed in the pocket 28, it is wedged between the edges of the webs 32*d*, 32*e* adjoining the pocket, and is thus snugly retained in the basket 10.

Unlike its webbed upper portion (the basket being oriented as shown in FIG. 3), the lower portion of the basket 10 is not perforated, but instead comprises a solid, flat, substantially semi-elliptical base member 34 which is parallel to the basket's long and transverse axis L, T. The edge of the base member 34 closer to the handle 16 comprises the opening's intermediate edge 26. The webs 32*a–e* radiate outwardly from the opposite edge of the base member 34, bending upwardly and then inwardly to form the partially ellipsoidal surface of the basket 10. The ends of the webs 32*a–e* terminate at the midpoint 42 of the basket's opening 22. The ends of the webs 32*a–e* are affixed to each other by a conventional threaded bolt and nut 36 extending through aligned holes in the ends of the webs. The basket formed by the central member and webs 32*a–e* is configured and is comprised of such a material such that the basket appears opaque in water, readily visible to the user.

The pole 12 is conventional per se, comprising a plurality of telescopically related tubular sections 14 and handle means 16 for manipulating the retriever. The telescoping pole 12 allows the retriever to be stored compactly when not in use, while providing sufficient length to reach and retrieve distant golf balls. As shown in FIG. 1, the pole 12 extends through the opening 22 at near the end 18 of the basket 10, and is affixed to the interior surface of the central member 34 of the basket opposite the pocket 28 by two U-shaped clips 38, 38'. Each of the clips 38, 38' is a flat elongated metal strip wrapped around the pole 12 and affixed to the lower member 34 of the basket 10 by a conventional threaded bolt and nut 40.

Affixing the pole 12 to the interior surface of the base member 34 provides the basket with a smooth exterior bottom surface which allows the lower edge 26 of the opening 22 to slide along the surface below the golf ball B, further facilitating scooping the ball into he basket 10. Attaching the pole 12 inside the central member 34 also prevents the golf ball B from rolling into the near end 18 of the basket, encouraging the ball to roll instead into the pocket 28 at the basket's far end 20 when the pole is lifted.

The pole is attached near one end of the basket on an interior surface thereof, and at an angle of 10 degrees-25 degrees relative to the axis L to effectively enlarge the "catching" area for the ball and facilitate use of the article under water to capture and retrieve golf balls. With such an arrangement, the article is effective with the basket in virtually any orientation relative to the ball to be retrieved.

The basket 10 is preferably fabricated from a single piece of flat sheet metal, with the central member 34 and radiating webs 32*a–e* stamped or cut out as a single flat element. The basket 10 is assembled by bending the flat webs 32*a–e* upwardly out of the plane of the base member 34 until their ends are superimposed, and then affixing them to each other by the bolt and nut 36 described above. The webs 32*a–e* are sized and cut to length so that when they are bent upwardly and their ends are affixed to each other, they produce a substantially ellipsoidal surface and their ends meet substantially at the basket's vertical axis V.

Alternative embodiments of the invention are possible and contemplated as being within the scope of this invention. Non-ellipsoidal baskets having suitable pockets at their ends are contemplated. Although the basket 10 is described as being fabricated from flat sheet metal, it might also be made of plastic, such as by cutting and bending as described above or by molding the basket as an integral element. Further, an alternative basket may be a solid, imperforate element having a solid surface, with the ball being retained in a completely enclosed pocket at the far end of the basket behind the downwardly curving far upper edge of the basket's opening. Alternative means for attaching the basket to the pole may be used with this invention, including welding the pole to the basket, or providing a stem attachable to the pole.

To retrieve a golf ball B using this invention, the golfer first positions the pole 12 so that the basket 10 at the end of the pole is on the far side of the ball B from the golfer. The golfer then pulls the retriever, scooping the ball B into the basket 10 through the opening 22 facing the golfer. The width of the opening 22 along the basket's long axis L as well as the spatial relationship between the pole and the basket allows the golfer to easily scoop the ball B into the basket 10. Once scooped into the basket 10, the golfer lifts and then swings, pulls or telescopes the pole 12 to bring the basket 10 within hand's reach, and removes the ball B from the basket.

Figure 4:
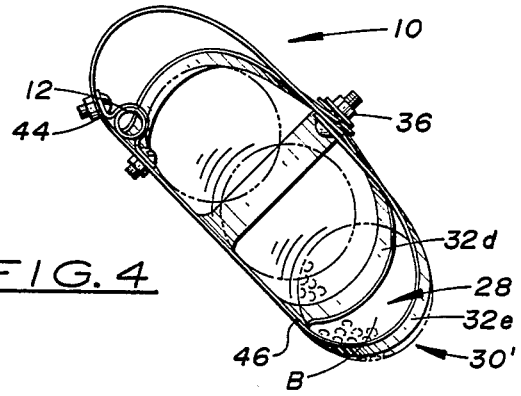
FIG. 4 is a side view of the basket of FIG. 1, showing the pole being lifted and the golf ball rolling along the basket's sloping ellipsoidal surface into the pocket.

As seen in FIGS. 1 and 4, when the ball B is in the basket 10 and the pole 12 is lifted by the user, the weight of the ball being offset from the pole's long axis will typically rotate the basket 10 downwardly until it hangs from the end of the pole as shown in FIG. 1, because of the rotation of the basket relative to the pole or the rotation of one section of the telescoping pole relative to the remainder thereof. As the basket 10 rotates downwardly, the ball B rolls downwardly along the substantially ellipsoidal back of the basket into the pocket 28, as shown by the dashed silhouette of the ball B in FIG. 4. The pocket 28 formed in the gap 30' between the two farthest webs **32*d*, 32*e* first stops the rolling ball B from falling out the opening 22 at the far end 20 of the basket, and then retains the ball B in the pocket until it can be manually removed by the golfer. The flat surface of the farthest web 32*e* cooperates with the pocket 28** to further prevent the ball from falling out of the basket.

It will be appreciated that, although a specific embodiment of the invention has been described herein for purposes for illustration, various modifications may be made without departing from the spirit and scope of the invention. Accordingly, the scope of the invention is not limited except as by the following claims.

I claim:

1. An apparatus for retrieving a golf ball, comprising:

an elongated pole having a handle portion at one end thereof; and a basket-like member attached to the pole at the other end thereof, wherein the basket-like member includes an elongated opening for receiving a golf ball thereinto, the elongated opening extending between opposing sides of the basket-like member, wherein the basket-like member is attached to the pole in such a manner that the basket-like member opens in the direction of the handle portion of the pole and extends generally across the longitudinal axis of the pole, wherein the basket-like member includes a rear surface opposite the elongated opening thereof, said rear surface being continuously curved between the opposing sides of the basket-like member, and a plurality of web elements, separated respectively by gaps, which extend from the flat base plate and terminates in free ends, the web elements being curved and joined together at the respective free ends thereof to form the basket-like member, wherein the area of the gaps between adjacent web elements is greater than the surface area of the web elements, and wherein the separation between adjacent web elements is sufficiently great that a golf ball tends to be retained between said adjacent web elements.

2. An article of claim 1, wherein the width of the elongated opening is slightly greater than the diameter of a golf ball, wherein the length of the elongated opening is approximately 5 inches, wherein the depth of the basket-like member at its deepest point is approximately 2 inches, and wherein the width of the web-like elements is approximately ½inch.

3. An article of claim 2, wherein the pole is attached to the basket-like member near one side thereof, at an angle within the range of 10° to 25° relative to an imaginary reference axis which is in the same plane as the pole and which intersects the plane of the elongated opening at a right angle.

* * * * *

UNITED STATES PATENT AND TRADEMARK OFFICE

CERTIFICATE OF CORRECTION

PATENT NO. : 4,844,526

DATED : July 4, 1989

INVENTOR(S) : Fred E. Young

It is certified that error appears in the above-identified patent and that said Letters Patent is hereby corrected as shown below:

Column 6, line 26, Claim 1, following the word "member," insert --wherein the basket-like member comprises a flat base plate--.

Claim 1, line: The word "terminates" should read --terminate--.

Signed and Sealed this

Twenty-fourth Day of April, 1990

*Attest:*

*Attesting Officer*

HARRY F. MANBECK, JR.

*Commissioner of Patents and Trademarks*